US005311888A

United States Patent [19]

Leigh

[11] Patent Number: 5,311,888

[45] Date of Patent: May 17, 1994

[54] ERGONOMIC MAKE-UP SHIELD

[76] Inventor: Mary E. Leigh, 604 Trotwood Ridge Rd., Pittsburgh, Pa. 15241

[21] Appl. No.: 91,423

[22] Filed: Jul. 12, 1993

[51] Int. Cl.[5] ..... A45D 40/30

[52] U.S. Cl. ..... 132/319; 132/216

[58] Field of Search ..... 132/216, 319, 320, 333; 2/15

[56] References Cited

U.S. PATENT DOCUMENTS

| | | | |
|---|---|---|---|
| 1,873,928 | 8/1932 | Bohner | 132/216 |
| 2,260,614 | 10/1941 | Freitas | 132/216 |
| 3,789,856 | 2/1974 | Bomba | 132/319 |
| 3,884,232 | 5/1975 | Braun | 132/333 |
| 4,807,650 | 2/1989 | Bliss | 132/319 |
| 5,016,658 | 5/1991 | Green | 132/319 |
| 5,050,624 | 9/1991 | Kobe et al. | 132/319 |
| 5,178,170 | 1/1993 | Kassai | 132/319 |

*Primary Examiner*—Gene Mancene
*Assistant Examiner*—Frank A. LaViola
*Attorney, Agent, or Firm*—Patrick Ciarrett

[57] ABSTRACT

The present invention is an ergonomic make-up shield. The make-up shield comprises an eye portion having a curved smooth edge for engaging against a person's face adjacent to the eye. The eye portion further has two side edges which define a first plane. The make-up shield also comprises a handle portion integrally attached to the eye portion. The handle portion forms a solid closed planar surface extending downwardly in a second plane essentially perpendicular to the first plane. Preferably, the closed planar surface provides a surface area of at least 0.50 square inches for providing ample surface area for ease of handling and ergonomic wrist positioning. The natural position of the wrist while grasping the handle portion between the thumb and the index finger turns the hand and knuckles sideways to provide a clear open area which is specifically the area where the other hand applies the make-up to the face. Another critical feature of the present invention is that the handle portion has a solid closed surface which provides a large surface area. In this manner the fingers can grasp and regrasp the handle in numerous locations. This feature is significant because the person cannot see the make-up shield during use due to its proximity to the eye and thus a large surface area is needed for the fingers to grasp and perhaps reposition on the handle.

11 Claims, 1 Drawing Sheet

ERGONOMIC MAKE-UP SHIELD

FIELD OF THE INVENTION

The present invention is related in general to cosmetic aids. More specifically, the present invention is related to a make-up shield for applying make-up.

BACKGROUND OF THE INVENTION

During application of make-up, such as mascara, it is a common problem that the make-up can end up on parts of the face where it is not desired. Accordingly, in the past, there have been attempts to provide a make-up shield which engage against the face to form a surface which prevents the make-up from being deposited on the face during make-up application. However, these make-up shields, in general, have been designed without little regard for comfort and ease of handling. Accordingly, few if any of these clumsy make-up shields are used or marketed.

The present invention discloses a make-up shield which is ergonomically designed. Its shape, besides being highly aesthetic, is easy to grasp and manipulate. These features are critical in that many people desire to make the process of make-up application a pleasing hassle free experience.

SUMMARY OF THE INVENTION

The present invention is an ergonomic make-up shield. The make-up shield comprises an eye portion having a curved smooth edge for engaging against a person's face adjacent to the eye. The eye portion has two side edges which define a first plane. The make-up shield also comprises a handle portion integrally attached to the eye portion. The handle portion forms a solid closed planar surface extending downwardly in a second plane essentially perpendicular to the first plane. Preferably, the closed planar surface provides a surface area of at least 0.50 square inches for providing ample surface area for ease of handling and ergonomic wrist positioning.

In a preferred embodiment the eye portion and the handle portion are comprised of a single piece of bent material, such as plastic. The eye portion is essentially a concave triangle which tapers into the handle portion. The handle portion is comprised of two folded curved tabs which abut in a parallel relationship. Preferably, the handle portion comprises a series of raised ridges for providing improved grip. A strip of the eye portion behind the edge can be frosted to enhance and define the edge. If desired the handle portion can also be frosted.

The present invention is also a method of making a make-up shield. The method comprises the steps of producing a planar sheet of material having an essentially triangular shaped eye portion which tapers towards a bulbous handle portion. Then there is the step of bending the handle portion about a center line of the planar sheet such that two opposing tabs are formed which abut against each other in a parallel fashion.

FIGS. *2a* and *2b* are schematic representations illustrating a method of making the make-up shield

DESCRIPTION OF THE PREFERRED EMBODIMENT

Figure 1:
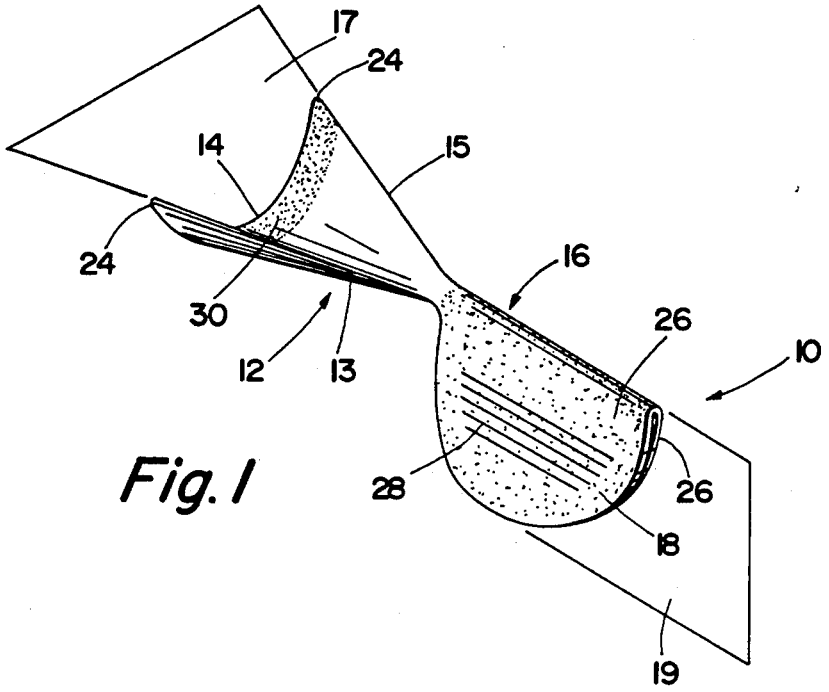
FIG. 1 is a schematic representation showing the make-up shield of the present invention.
Figure 2A:
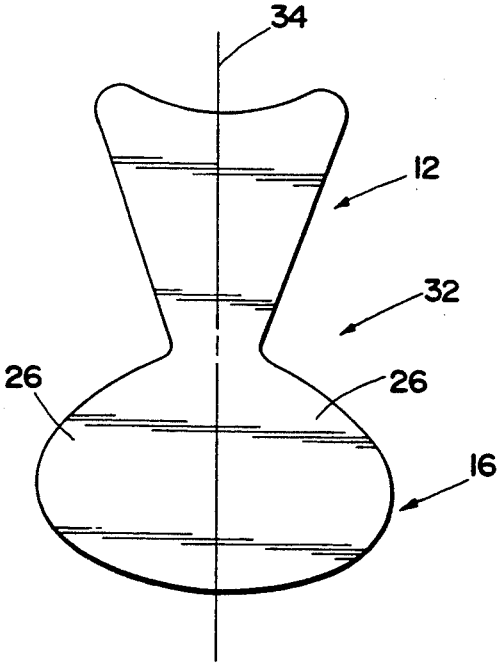
Figure 2B:
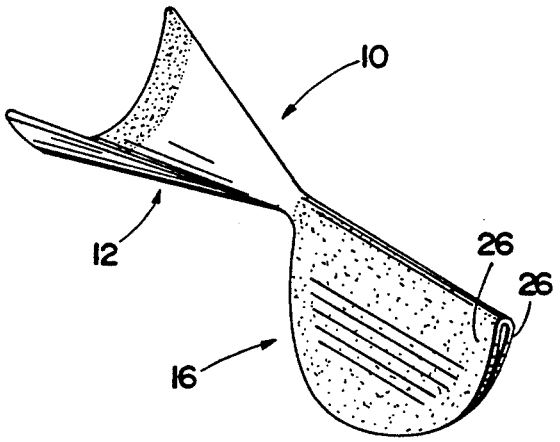

Referring now to the drawings wherein like reference numerals refer to similar or identical parts throughout the several views and more specifically to FIG. 1 thereof there is shown an ergonomic make-up shield 10. The make-up shield 10 comprises an eye portion 12 having a curved smooth edge 14 for engaging against a person's face adjacent to the eye. The eye portion 12 further includes two side edges 13 and 15 which define a first plane 17. The make-up shield 10 also comprises a handle portion 16 integrally attached to the eye portion 12. The handle portion 16 forms a solid closed planar surface 18 extending downwardly in a second plane 20 essentially perpendicular to the first plane 22. Preferably, the closed planar surface 18 provides a surface area of at least 0.50 square inches for providing ample surface are for ease of handling and ergonomic wrist positioning. More preferably, the closed planar surface 18 provides at least 1 square inch.

It should be appreciated that the natural position of the wrist while grasping the handle portion 16 between the thumb and the index finger turns the hand and knuckles sideways to provide a clear open area which is specifically the area where the other hand applies the make-up to the face. If, in contrast, the handle portion 16 was turned 90 degrees (i.e. parallel to the first plane) the knuckles of the finger would face upward thus interfering with the application of make-up.

Another critical feature of the make-up shield 10 is that the handle portion 16 has a solid closed surface 18 which provides a large surface area. In this manner the fingers can grasp and regrasp the handle portion 16 in numerous locations. This feature is significant because the person typically cannot see the make-up shield 10 during use due to its close proximity to the eye. Thus a large surface area is needed for the fingers to grasp and perhaps reposition on the handle portion 16.

In a preferred embodiment the eye portion 12 and the handle portion 16 are comprised of a single piece of bent material. Preferably, the material is a clear plastic, but is not limited thereto. The eye portion 12 is essentially a concave triangle which tapers into the handle portion 16. The corners 24 at the ends of the edge 14 are curved. The handle portion 12 is comprised of two folded curved tabs 26 which abut in parallel relationship. Preferably, the handle portion 16 comprises a series of raised ridges 28 for providing improved grip. A strip 30 of the eye portion 12 behind the edge 14 can be frosted to enhance and define the edge 14. If desired the handle portion 16 can also be frosted.

The present invention is also a method of making a make-up shield 10. The method comprises the steps of producing a planar sheet of material 32 having an essentially a triangular shaped eye portion 12 which tapers towards a bulbous handle portion 14. Then there is the step of bending the handle portion 16 about a center line 34 of the planar sheet 32 such that two opposing tabs 26 are formed which abut against each other in a parallel fashion.

Preferably, the producing step is comprised of the step of stamping the planar sheet 32 from sheet material. Preferably, after the producing step there is the step of bending the eye portion 12 into a concave shape. This can be accomplished be pressing the eye portion against a curved mandrel. If the material is plastic, before the bending step there is the step of heating the plastic such that it is formable.

In an example of the operation of the invention, the make-up shield 10 is used to guard the face during the application of mascara to the lashes on the lower eyelid. While looking in the mirror, one hand is used to apply the mascara with a conventional mascara brush. The other hand grasps the handle portion 16 between thumb and index finger and holds the smooth edge 14 against the portion of the face below the eye to shield the face from the mascara brush. The large downwardly extending handle portion 16 is easy to control and can be easily tilted and regrasped with two fingers for repositioning.

Although the invention has been described in detail in the foregoing embodiments for the purpose of illustration, it is to be understood that such detail is solely for that purpose and that variations can be made therein by those skilled in the art without departing from the spirit and scope of the invention except as it may be described in the following claims.

I claim:

1. An ergonomic make-up shield comprising:

an eye portion having a curved smooth edge for engaging against a person's face adjacent to the eye; and a handle portion integrally attached to the eye portion, said handle portion forming a solid closed planar surface extending from said eye portion, said eye portion essentially a concave triangle which tapers into the handle portion and said handle portion comprised of two folded curved tabs which abut in a parallel relationship.

2. A make-up shield as described in claim 1 wherein the closed planar surface has a surface area of at least 0.05 square inches for providing ample surface area for ease of handling and ergonomic wrist positioning.

3. A make-up shield as described in claim 2 wherein the eye portion and the handle portion are comprised of a single piece of material.

4. A make-up shield as described in claim 3 wherein the handle portion includes a series of raised ridges for providing improved grip.

5. A make-up shield as described in claim 4 wherein the material is comprised of plastic.

6. A make-up shield as described in claim 5 wherein the eye portion has a frosted strip adjacent to the curved edge and a clear tapering portion extending from the frosted strip to the handle portion.

7. A make-up shield as described in claim 6 wherein the handle portion has a frosted surface.

8. A method of making a make-up shield comprising the steps of:

producing a planar sheet of material having an essentially triangular shaped eye portion which tapers towards a bulbous handle portion; and bending the handle portion about a center line of the planar sheet such that two opposing tabs are formed which abut against each other in a parallel fashion.

9. A method as described in claim 8 wherein the producing step is comprised of the step of stamping the planar sheet from sheet material.

10. A method as described in claim 9 wherein after the producing step there is the step of bending the eye portion into a concave shape.

11. A method as described in claim 10 wherein the planar sheet is comprised of plastic and before the bending step there is the step of heating the plastic such that it is formable.

* * * * *